United States Patent [19]

Laudig

[11] 4,178,054

[45] Dec. 11, 1979

[54] PLUG TERMINATION FOR COAXIAL CABLE

[75] Inventor: Ronald C. Laudig, Mechanicsburg, Pa.

[73] Assignee: AMP Incorporated, Harrisburg, Pa.

[21] Appl. No.: 826,801

[22] Filed: Aug. 22, 1977

[51] Int. Cl.[2] ..... H01R 11/08; H01R 17/08

[52] U.S. Cl. ..... 339/95 R; 339/177 R; 339/223 R; 339/276 T

[58] Field of Search ..... 339/95 R, 97 C, 177 R, 339/177 E, 223 S, 223 R, 276 R, 276 T

[56] References Cited

U.S. PATENT DOCUMENTS

| | | | |
|---|---|---|---|
| 3,154,362 | 10/1964 | Bonder et al. | 339/97 C |
| 3,670,293 | 6/1972 | Garver | 339/177 R |
| 3,793,616 | 2/1974 | Moehrke | 339/223 S |
| 4,010,538 | 3/1977 | O'Keefe et al. | 339/177 E |

FOREIGN PATENT DOCUMENTS

| | | | |
|---|---|---|---|
| 1007053 | 10/1965 | United Kingdom | 339/177 R |

*Primary Examiner*—Neil Abrams

[57] ABSTRACT

A plug termination for a coaxial cable comprising a main body having a first collar means positioned around a portion of said cable with the braid stripped away and with a pair of spring fingers for mating with a female receptacle extending therefrom substantially parallel with the cable. A third finger, with prongs and a burr or lance formed on the end thereof, also extends from the collar means beyond said first fingers and substantially parallel with the cable. A fourth element having a barrel means formed on the end thereof also extends from said collar means substantially parallel with said spring fingers. The barrel means is crimped around the end of the said third finger to drive the prongs into the cable braid and to drive the lance into the outer insulative sheath of the cable as a strain relief. An insulative spacer with an aperture therethrough is retained in said collar means, with a tubular center contact being retained in said aperture and extending outwardly therefrom in a direction opposite said first fingers. The cable center conductor is crimped within said tubular center contact.

1 Claim, 7 Drawing Figures

PLUG TERMINATION FOR COAXIAL CABLE

BACKGROUND OF THE INVENTION

This invention relates generally to an electrical termination for a coaxial cable and more particularly to an improved plug terminating means for the end of a coaxial cable of the type employed with antennas, for example.

In the present state of the art plugs employed for terminating coaxial antenna cables usually require the soldering of both the braid and the center conductor cable to the outer contact and the center contact of the plug, respectively. Because soldering is required, the prior art plugs are best handled individually during the manufacturing thereof and also during the installation thereof to the end of a coaxial cable. Both the soldering operations and the individual handling appreciably increase the cost of the final product.

BRIEF STATEMENT OF THE INVENTION

It is a primary object of the invention to provide a simple antenna cable plug which requires no soldering during its manufacture or during its application to an antenna cable.

A second aim of the invention is to provide an inexpensive but reliable antenna plug which can be manufactured in strip form, i.e., with a carrier, to facilitate automatic application of the plug to an antenna cable or other coaxial cable.

A third purpose of the invention is to provide an inexpensive antenna plug which can be completely stamped and formed and which requires no soldering.

A fourth object of the invention is the improvement of coaxial cable plug terminating means generally.

In one preferred form of the invention the main body of the plug connector is generally cylindrical in shape and comprises a collar means with a pair of oppositely positioned first resilient finger-like elements extending therefrom in a direction generally parallel to the axis of the connector body and being bowed with the convex side thereof facing away from said axis. Such first finger-like elements frictionally fit within a female receptacle. The main body of the connector further comprises a second finger-like element which also extends from said collar means in a direction generally parallel with and between said finger-like elements to a point beyond the ends of said first finger-like elements and with the end thereof having lances or burrs and prongs protruding therefrom towards the cable retained in the connector. A fourth element also extends from said collar means generally parallel with and beyond the ends of said first finger-like elements and comprises at the end thereof a barrel means which is crimpable around the end of the said second finger-like means to drive the prongs into the braid of the coaxial cable and make electrical contact therewith and to drive the burr into the plastic sheath of the cable.

An insulative spacer element is retained within said collar means and has an aperture centered therein within which a cylindrically-shaped center contact is retained. The stripped center conductor of the cable extends through said center contact and is crimped therein.

In accordance with a feature of the invention the center contact is secured in the insulative spacer by small indentations on one side of the dielectric and by a flared flange on the other side of the dielectric. This sub-assembly is then secured into the main body of the connector by means of a staking operation. The entire connector assembly can be retained on the carried strip carrying the main bodies of the connectors for installation on coaxial cables.

BRIEF DESCRIPTION OF THE DRAWINGS

The above-mentioned and other objects and features of the invention will be more fully understood from the following detailed description thereof when read in conjunction with the drawings in which.

DETAILED DESCRIPTION OF THE INVENTION

Figures 1, 2, 3, 4, 5, 6:
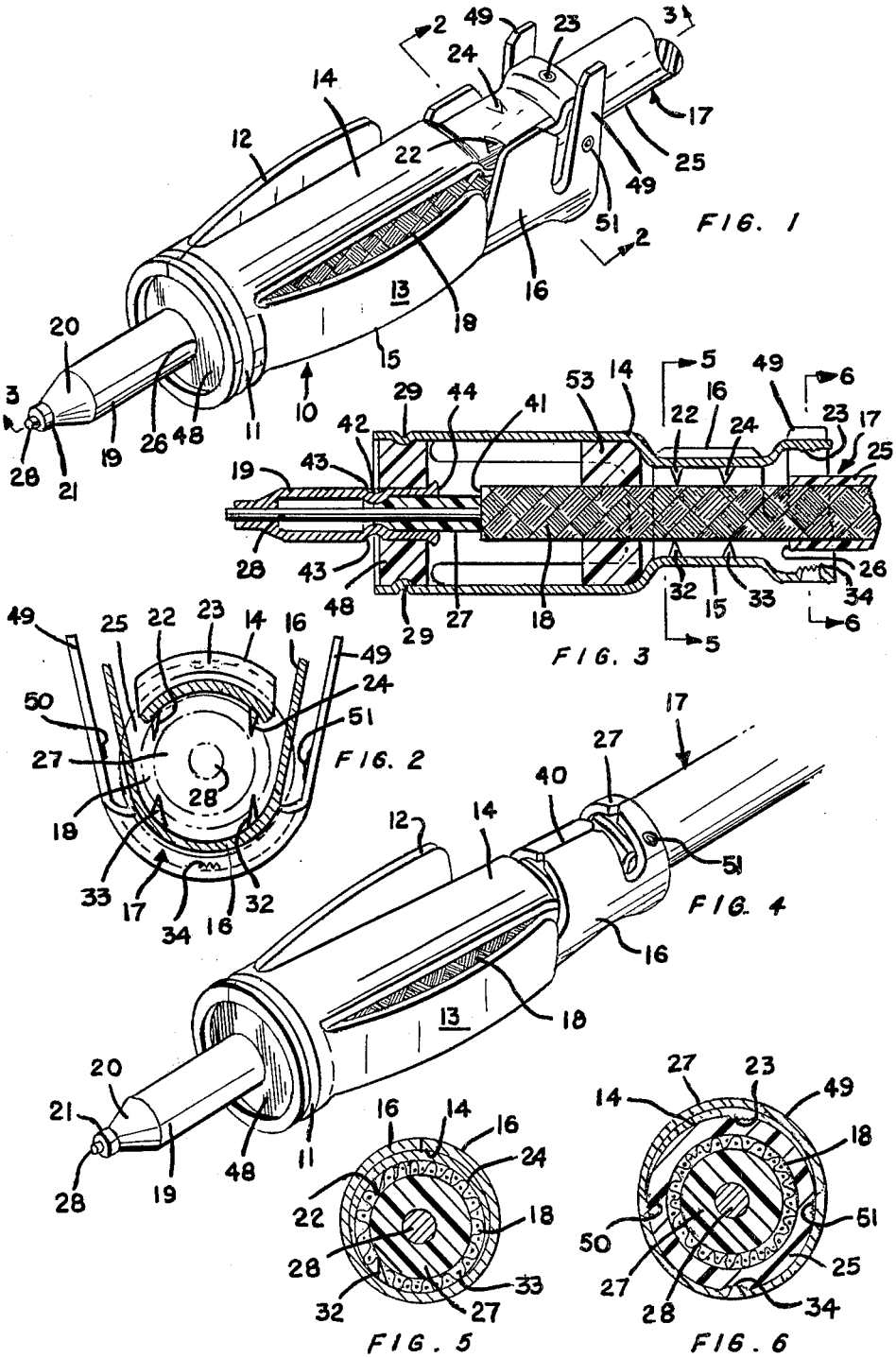
FIG. 1 is an isometric view of one form of the invention before crimping to a coaxial cable, and with a portion thereof broken away.
FIG. 2 shows a sectional view of FIG. 1 in the plane 2—2.
FIG. 3 is a sectional view of FIG. 1 in the plane 3—3.
FIG. 4 shows an isometric view of the invention after being crimped onto a coaxial cable and with a portion thereof broken away.
FIG. 5 is a sectional view of FIG. 4 taken in the plane 5—5.
FIG. 6 is a sectional view of FIG. 4 taken in the plane 6—6.

In FIG. 1 the main body 10 of the plug has a generally cylindrical collar 11 which is crimped around an insulating spacer 48. The center contact 19 fits within an aperture 26 in the insulating spacer 48 in a manner which will be described later in more detail in the discussion of FIG. 3

The main body 10 of the connector has a pair of resilient finger-like elements 12 and 13 which extend from collar means 11 in a direction substantially parallel to the axis of collar means 11 and positioned on either side of the coaxial cable 17. The purpose of the resilient finger-like elements 12 and 13 is to engage a female receptacle (not shown) into which the plug of the invention fits.

Also extending from collar means 11 is another finger 14 which extends beyond the ends of finger-like elements 12 and 13 and has a pair of prongs 22 and 24 formed therein and a burr or lance 23. The prongs 22 and 24 are designed to penetrate into the conductive braid 18 of the coaxial cable 17 by means of crimpable barrel means 16 which is attached to the first collar means 11 by means of a finger-like element 15. The barrel means 49 crimps around the burr 23 to cause said burr 23 to penetrate into the plastic sheath 25 covering the cable 17 and act as a strain relief.

The relationship of prongs 22 and 24 and burr 23 on finger 14 and the barrel means 16 and 49 is better shown in the end view of FIG. 2. It can be seen in FIGS. 2 and 5 that barrel means 16 can also have a pair of prongs 32 and 33 and barrel means 49 can haveburrs 34, 50 and 51 formedthereon which are designed to penetrate through the braid 18 of cable 17 and the plastic sheath 25 of cable 17, respectively.

In FIG. 3 there is shown a sectional view of the structure of FIG. 1 taken along the plane 3—3 which more clearly shows the relationship of the stripped portions of the coaxial cable with respect to the connector. More specifically, the plastic sheath 25 is removed somewhere around the point 27 so that it extends under the burrs or lances 23, 50, 51 and 34 but not under the prongs 22, 24, 32 or 33. The braided portion 18 extends into the connector past the prongs 22 and 24 of finger 14 and the prongs 32 and 33 of crimpable barrel means 16 so that when barrel 16 is crimped around the cable the prongs 22, 24, 32 and 33 will make contact directly with the braid 18 of cable 17, which braid terminates at a point indicated by reference character 41 so that it does not contact center contact 19.

For purposes including alignment the cable dielectric 27 can extend into the center contact 19 to some point indicated by reference character 42. The inner conductor 28 of coaxial cable 17 extends beyond the point 42 and into the small end 21 of center contact 19. Such small end 21 is crimped around the center conductor 28 as indicated in FIG. 4.

Center contact 19 can be secured within insulative spacer 48 by means of indentations 43 on one side thereof and by flaring the end of the center contact on the other side of insulated spacer 48, as indicated by reference character 44. The main body 10 of the connector is secured to the insulated spacer 48 by means of a crimp 29 around the perimeter thereof. A second insulative spacer 53 can be employed to add strength to the connector.

In FIGS. 4, 5 and 6 the barrel means 16 and 49 are shown crimped around the end of finger 14 and also around the coaxial cable 17 to push the prongs 22 and 24 into the braid 18 and the burr 23 into the plastic sheath 25. The prongs 32 and 33 and the burrs 34 and 50 and 51 formed on barrel means 49 are also forced into the braid 18 and the plastic sheath 25, respectively, of cable 17. At the other end of the connector the tip 21 of center contact 19 has been crimped around the center conductor 28 of cable 17. FIG. 5 is taken along the plane 5—5 of FIG. 3 and FIG. 6 is taken along the plane 6—6 of FIG. 3.

Figure 7:
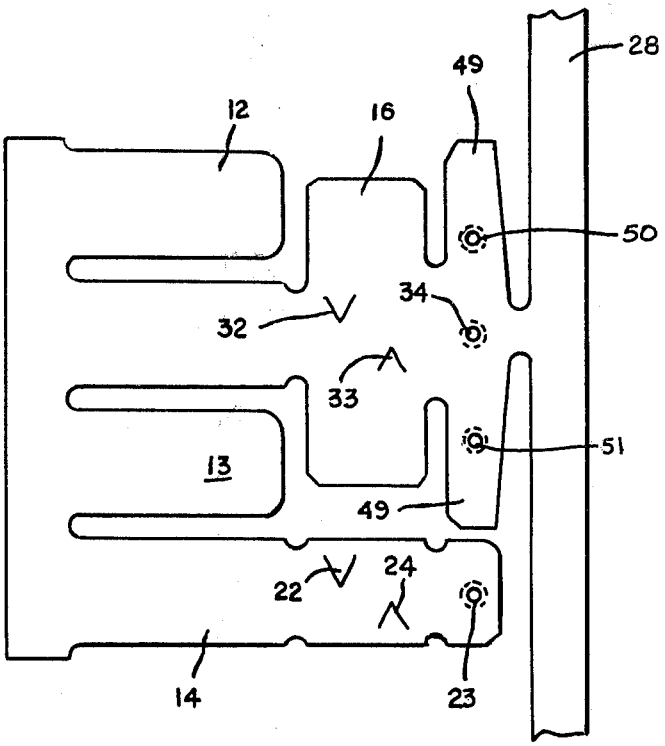
FIG. 7 shows the blank form of the main body portion of the invention secured upon a carrier strip and before forming.

Both the main body 10 and center contact 19 can be either stamped and formed from a sheet of metal or the center contact can be drawn. FIG. 7 shows the stamped blank form of a main body 10 before forming, and connected to a carrier strip 30. Portions of FIG. 7 corresponding to portions of FIGS. 1 through 5 are identified by the same reference characters. Stamping and forming of the main body 10 or the center contact 19 (FIGS. 1 and 4) can be done while they are on a carrier strip. In one method of manufacturing the center contacts 19 are stamped and formed and then secured in the stamped insulative spacers 48. The resultant sub-assemblies are then secured within the carrier held stamped and formed main bodies 10.

The form of the invention shown and described herein is but a preferred embodiment thereof and various changes can be made by one skilled in the art without departing from the spirit or scope of the invention.

I claim:

1. In a plug type connector body having an inner center contact connected to a center conductor of a coaxial cable and an outer one-piece connector shell connected to the conductive sheath of the cable and separated from the center contact and center conductor by dielectric material, the improvement comprising:

said shell being partially divided into first means and first and second split barrel sections;

said first means being deflectable resiliently in a direction radially of said cable for an internal frictional fit upon making a plug-in electrical connection with said plug type connector body.

said first split barrel section compressibly encircling and engaging said conductive sheath;

said second split barrel section compressibly encircling an outer jacket of said coaxial cable which covers said conductive sheath;

said shell including second means integral with a first end of said shell and extending towards said first and said second split barrel sections and being compressibly encircled and engaged by each of said split barrel sections;

said second means including an integral projecting lance internally of said encircling first split barrel section and penetrating into said sheath;

said second means including a second integral projecting lance internally of said encircling second split barrel section and penetrating into said jacket; and said first and second split barrel sections including projecting lances which penetrate into said sheath and said jacket, respectively.

* * * * *